US008571435B2

(12) United States Patent
Kusakabe

(10) Patent No.: US 8,571,435 B2
(45) Date of Patent: Oct. 29, 2013

(54) IMAGE FORMING APPARATUS THAT PREVENTS TONER FROM ESCAPING THE DEVELOPING AREA

(75) Inventor: Kazushi Kusakabe, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 315 days.

(21) Appl. No.: 13/041,021

(22) Filed: Mar. 4, 2011

(65) Prior Publication Data

US 2011/0217065 A1 Sep. 8, 2011

(30) Foreign Application Priority Data

Mar. 8, 2010 (JP) ..... 2010-050410

(51) Int. Cl.
*G03G 21/20* (2006.01)
*G03G 21/00* (2006.01)

(52) U.S. Cl.
USPC ..... 399/92; 399/98

(58) Field of Classification Search
USPC ..... 399/92, 91, 98, 99, 101
See application file for complete search history.

(56) References Cited

U.S. PATENT DOCUMENTS

| | | | | |
|---|---|---|---|---|
| 7,917,051 | B2 * | 3/2011 | Kusakabe | 399/92 |
| 2005/0244178 | A1 * | 11/2005 | Kitayama | 399/49 |
| 2007/0110468 | A1 * | 5/2007 | Shimazu et al. | 399/92 |

FOREIGN PATENT DOCUMENTS

| | | |
|---|---|---|
| JP | 63-147172 | 6/1988 |
| JP | 1-108564 | 7/1989 |
| JP | 2-109359 | 8/1990 |
| JP | 4-36781 | 2/1992 |
| JP | 5-45945 | 2/1993 |
| JP | 6-317951 | 11/1994 |
| JP | 7-199607 | 8/1995 |
| JP | 8-185110 | 7/1996 |
| JP | 10-161489 | 6/1998 |
| JP | 2001-175152 | 6/2001 |
| JP | 2002-91270 | 3/2002 |
| JP | 2002-278387 | 9/2002 |

(Continued)

OTHER PUBLICATIONS

Machine translation of reference Yunamochi et al. (JP 2002-278,387 A), Listed in IDS. Pub date Sep. 27, 2002.*

(Continued)

*Primary Examiner* — Walter L Lindsay, Jr.
*Assistant Examiner* — Rodney Bonnette
(74) *Attorney, Agent, or Firm* — Morrison & Foerster LLP

(57) ABSTRACT

An image forming apparatus has a toner image carrier that rotates in a specified direction, a developing device comprising a toner supporting member that faces to a surface of the toner image carrier to form a developing area and that rotates in a same direction with the toner image carrier at the developing area, a transfer member for transferring a toner image from the surface of the toner image carrier onto a recording sheet, a guide for guiding a recording sheet to between the toner image carrier and the transfer member, and an air aspirator for aspirating air from the developing area and a location of the guide to a location of the transfer member. The air aspirator causes a first airflow, which carries toner, from the developing area and a second airflow, which does not carry toner, from the location of the guide. The second airflow prevents the first airflow from flowing to the location of the guide. Further, an opening is made at a position upstream from the guide with respect to a direction of the second airflow as an air inlet of the second airflow.

4 Claims, 4 Drawing Sheets

(56) References Cited

FOREIGN PATENT DOCUMENTS

| | | |
|---|---|---|
| JP | 2003-295713 | 10/2003 |
| JP | 2006-171475 | 6/2006 |
| JP | 2007-248826 | 9/2007 |
| JP | 2011-2594 | 1/2011 |

OTHER PUBLICATIONS

Notification of Reasons for Refusal, mailed Feb. 7, 2012, directed to Japanese Patent Application No. 2010-050410; 5 pages.

* cited by examiner

IMAGE FORMING APPARATUS THAT PREVENTS TONER FROM ESCAPING THE DEVELOPING AREA

This application is based on Japanese Patent Application No. 2010-050410 filed on Mar. 8, 2010, the content of which is incorporated herein by reference.

BACKGROUND OF THE INVENTION

1. Field of the Invention

The present invention relates to an image forming apparatus, and more particularly to an image forming apparatus for forming a toner image on a recording sheet by an electrophotographic process, such as an electrophotographic copying machine, printer, facsimile, etc.

2. Description of Related Art

Image forming apparatuses for forming toner images on recording sheets by an electrophotographic process have been developed into various types. FIG. 4 shows a model of such an image forming apparatus that the present inventors considered as a premise of the present invention. In the model shown by FIG. 4, a developing roller 42 for supporting toner in a layer, a first guide 25*a*, a second guide 25*b* and a transfer roller 34 are disposed around the circumference of a photosensitive drum 26 in this order in a direction shown by arrow "a". A recording sheet is fed from a lower part in FIG. 4 and fed by a pair of timing rollers 24 through between the guides 25*a* and 25*b*, and a toner image is transferred onto the sheet while the sheet is being fed nipped between the photosensitive drum 26 and the transfer roller 34. Further, a fan (not shown) is disposed above the transfer roller 34 so as to suck up air around the photosensitive drum 26 and to exhaust the air to the outside.

The toner supported on the developing roller 42, which is shaped into a magnetic brush, flies and floats in the air by jumping-up and galling-over of the magnetic brush or by contact with the photosensitive drum 26 at a developing area D. The toner floating in the air is carried by airflows formed by rotations of the photosensitive drum 26, the developing roller 42 and the fan, and the toner flows along the circumference of the photosensitive drum 26, between the guides 25*a* and 25*b* and along the circumference of the transfer roller 34 as shown by arrows in FIG. 4. In this moment, the toner sticks to the guides 25*a* and 25*b*, which causes a problem that the recording sheet is begrimed with the toner stuck on the mutually opposite surfaces of the guides 25*a* and 25*b*.

On the mutually opposite surfaces of the guides 25*a* and 25*b*, in an area where recording sheets of an often used size pass, toner is not deposited because toner is taken away from the area little by little every time a recording sheet of the often used size passes between the guides 25*a* and 25*b*. Outside the area, however, toner stuck on the mutually opposite surfaces of the guides 25*a* and 25*b* is not taken away unless a recording sheet of a large size passes between the guides 25*a* and 25*b*, and a large amount of toner is deposited there. Then, when a recording sheet of a large size passes between the guide 25*a* and 25*b*, the recording sheet is begrimed so heavily as can be seen. Additionally, the deposited toner may fall in lumps by vibration and may begrime the inside of the apparatus.

As a measure to prevent the inside of the image forming apparatus and recording sheets from being begrimed with toner flying from the developing device, Japanese Patent Laid-Open Publication No. 2002-278387 suggests that outside air be caused to flow in an airflow path between a developing device and a transfer guide by a fan to prevent the flying toner from depositing on the transfer guide. In order to implement this measure, however, components for forming the airflow path are necessary, thereby increasing the number of necessary components and increasing the cost. Also, as a measure to prevent recording sheets from being begrimed with toner and dust deposited on a protection lens of an exposure device, Japanese Patent Laid-Open Publication No. 5-45945 and Japanese Patent Laid-Open Publication No. 6-317951 suggest that an airflow be caused around the protection lens and that an air curtain be formed between the protection lens and a photosensitive drum. In order to implement this measure, however, a fan and a duct are necessary, thereby, increasing the number of components and increasing the cost.

SUMMARY OF THE INVENTION

An object of the present invention is to provide an image forming apparatus that can prevent members around a developing area, such as guide members, from being begrimed with toner flying from the developing area, thereby further preventing recording sheets and the inside of the image forming apparatus from being begrimed with toner.

In order to attain the object, an image forming apparatus according to an embodiment of the present invention comprises: a toner image carrier that rotates in a specified direction; a developing device comprising a toner supporting member that faces to a surface of the toner image carrier to form a developing area and that rotates in a same direction with the toner image carrier at the developing area; a transfer member for transferring a toner image from the surface of the toner image carrier onto a recording sheet; a guide for guiding a recording sheet to between the toner image carrier and the transfer member; and an air aspirator for aspirating air from the developing area and a location of the guide to a location of the transfer member, wherein the air aspirator causes a first airflow, which carries toner, from the developing area and a second airflow, which does not carry toner, from the location of the guide, wherein the second airflow prevents the first airflow from flowing to the location of the guide; and wherein an opening is made at a position upstream from the guide with respect to a direction of the second airflow as an air inlet of the second airflow.

BRIEF DESCRIPTION OF THE DRAWINGS

This and other objects and features of the present invention will be apparent from the following description with reference to the accompanying drawings, in which.

DETAILED DESCRIPTION OF THE INVENTION

An image forming apparatus according to an embodiment of the present invention is hereinafter described with reference to the accompanying drawings.

General Structure of the Image Forming Apparatus

Figure 1:
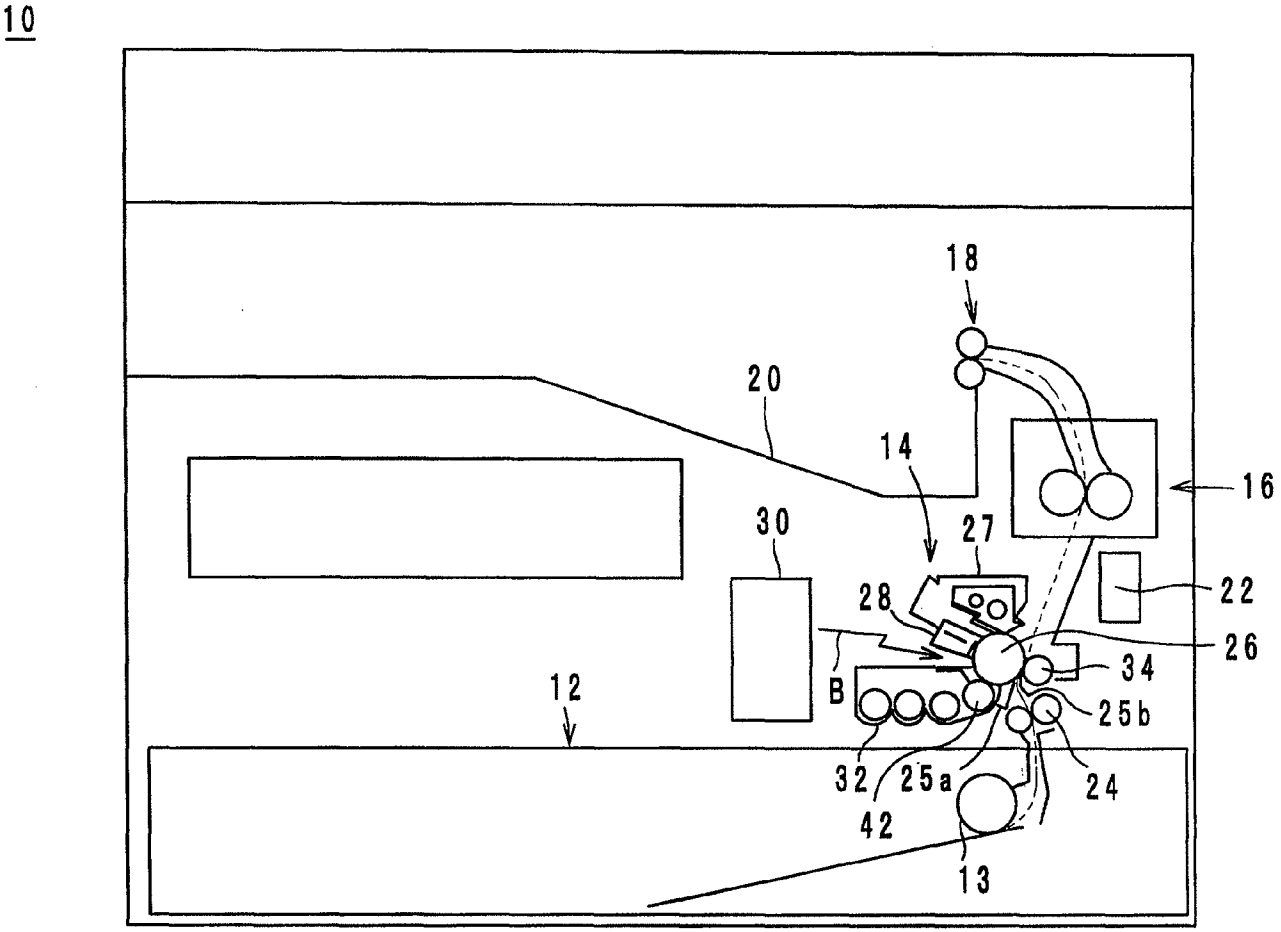
FIG. 1 is a skeleton framework of an image forming apparatus according to an embodiment of the present invention.

An image forming apparatus 10 is structured as an electrophotographic copying machine or printer, and as shown by FIG. 1, comprises a feed unit 12, an image forming unit 14, a fixing unit 16, a pair of ejection rollers 18, a printed-sheet tray 20 and a fan 22. In the feed unit 12, a plurality of recording sheets are stored in a stack, and a feed roller 13 feeds out the recording sheets one by one to the image forming unit 14.

The image forming unit 14 comprises a pair of timing rollers 24, a first guide 25*a*, a second guide 25*b*, a photosensitive drum 26, a residual toner/charge cleaner 27, a charger 28, a laser scanning device 30, a developing device 32 and a transfer roller 34. The image forming unit 14 will be described in more detail later.

The fixing unit 16 comprises a pair of fixing rollers and carries out a pressure/heat treatment toward a recording sheet passing between the pair of fixing rollers, thereby fixing a toner image on the recording sheet. The pair of ejection rollers 18 ejects the recording sheet from the fixing unit 16 onto the printed-sheet tray 20.

The fan 22 is an air aspirator and cools down the inside of the image forming apparatus 10 by exhausting air from the image forming apparatus 10. The fan 22 is, as shown in FIG. 1, disposed downstream from the image forming unit 14 in a sheet feeding direction. By operation of the fan 22, airflows occur inside the image forming apparatus 10 as will be described later.

Now, the structure of the image forming unit 14 is described with reference to FIG. 2. The photosensitive drum 26 is cylindrical and functions as a toner image carrier. The photosensitive drum 26 is driven by a motor (not shown) to rotate in a direction of arrow "a".

As shown in FIG. 1, the charger 28 is disposed to face to the circumferential surface of the photosensitive drum 26 and charges the surface of the photosensitive drum 26 evenly with a specified potential. The laser scanning device 30 is controlled by a control section (not shown) to emit a laser beam B to the surface of the photosensitive drum 26 in accordance with image data outputted from an image reader (scanner) or a computer. Thereby, an electrostatic latent image is formed on the surface of the photosensitive drum 26.

A developing device 32 is disposed such that a developing roller for supporting toner faces to the photosensitive drum 26, and the developing device 32 develops (visualizes) the electrostatic latent image formed on the surface of the photosensitive drum 26. In the developing device 32, toner is stored in a case 40, and as shown in FIG. 2, the developing roller 42 is located to face to the photosensitive drum 26 with a very small gap in-between. The area where the developing roller 42 and the photosensitive drum 26 face to each other is referred to a developing area D.

The developing roller 42 is driven by a motor (not shown) to rotate in a direction "b" and supplies toner to the developing area D so as to apply toner to the surface of the photosensitive drum 26. Although the developing device 32 further comprises a supply roller, a toner refill device, etc., descriptions of these members are omitted.

Figure 2:
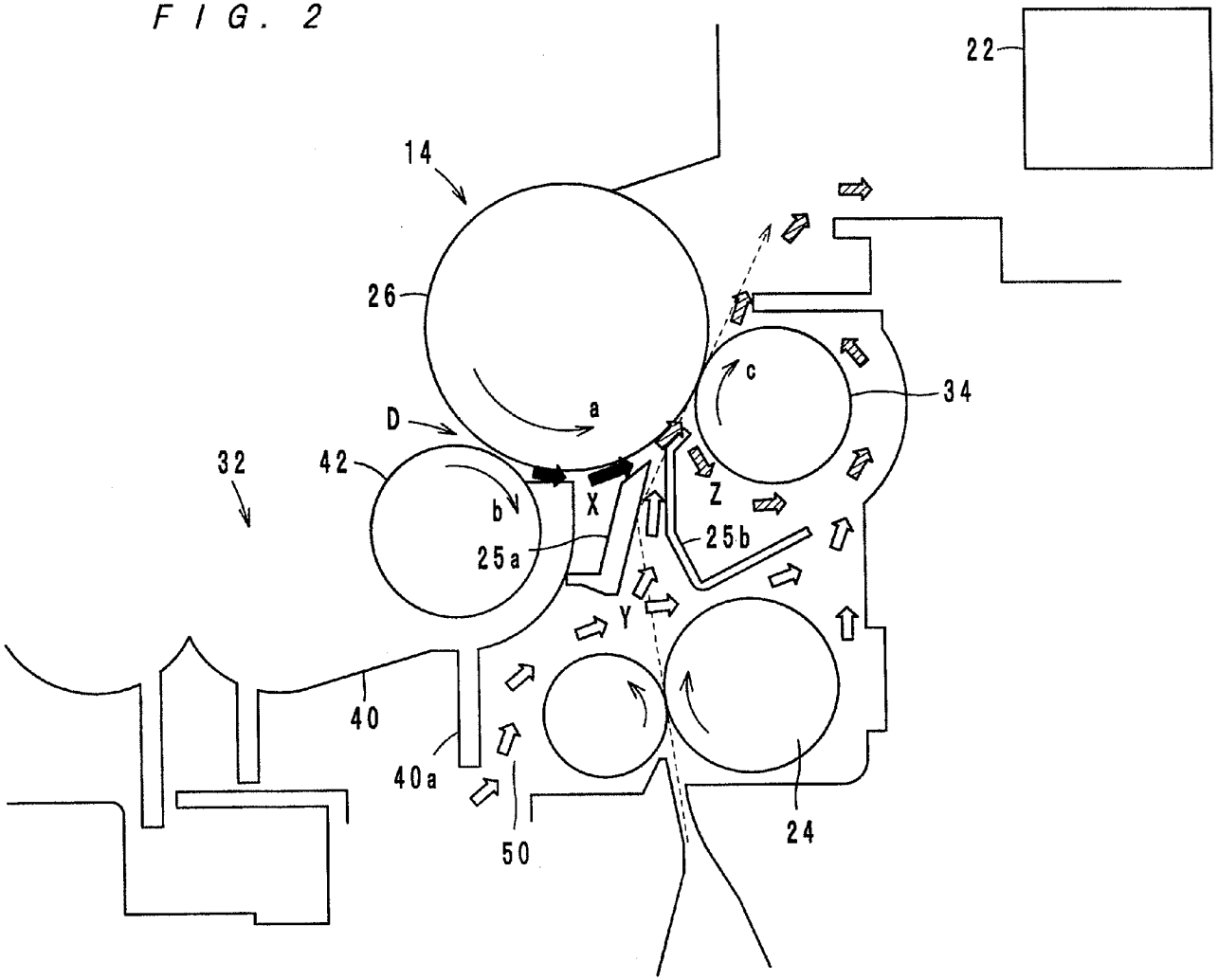
FIG. 2 is an enlarged view of a photosensitive drum and the periphery thereof in the image forming apparatus, showing airflows therearound.

As shown in FIG. 2, the transfer roller 34 is disposed to face to the photosensitive drum 26 at a position downstream from the developing roller 42 in the direction "a". The transfer roller 32 applies an electric field to a recording sheet passing a nip portion between the transfer roller 32 and the photosensitive drum 26 so as to transfer the toner image from the photosensitive drum 26 to the recording sheet. The transfer roller 34 is driven by a motor (not shown) to rotate in a direction "c".

The pair of timing rollers 24, as shown in FIG. 2, feeds a recording sheet fed out of the feed unit 12 to the nip portion between the photosensitive drum 26 and the transfer roller 34.

The first guide 25*a* and the second guide 25*b* are disposed downstream from the developing device 23 and upstream from the transfer roller 34 with respect to the direction "a" and guide the recording sheet fed by the pair of timing rollers 24 to the nip portion between the photosensitive drum 26 and the transfer roller 34. The first guide 25*a* is disposed by the side of the recording sheet path, closer to the developing area D, and the second guide 25*b* is disposed by the side of the recording sheet path, closer to the transfer roller 34. The first guide 25*a* has an upper end close to the surface of the photosensitive drum 26. The second guide 25*b* has an upper portion extending along the circumferential surface of the photosensitive drum 26 close to the transfer roller 34. The mutually opposite surfaces of the guides 25*a* and 25*b* guide a recording sheet.

The second guide 25*b* has a lower portion immediately above a right roller (in FIG. 2) of the pair of timing rollers 24, so that a space is formed between the second guide 25*b* and the transfer roller 34.

In the image forming apparatus 10, in order to form an image, the photosensitive drum 26 rotates in the direction "a", the developing roller 42 rotates in the direction "b", and the transfer roller 34 rotates in the direction "c". In the meantime, toner flies away from the developing roller 42. Also, the fan 22 operates to suck up the air inside the apparatus and to exhaust the air. Thereby, in the image forming unit 14, airflows from the developing area D and locations of the guides 25*a* and 25*b* to the location of the transfer roller 42 occur.

More specifically, the airflows include a first airflow X from the developing area D (shown by filled arrows in FIG. 2) and a second airflow Y from the locations of the first guide 25 (shown by open arrows in FIG. 2). The first airflow X carries toner flying from the developing area D, and the second airflow Y does not carry toner. In order to form the second airflow Y effectively, an opening 50 is made at an upstream point of the second airflow Y as an air inlet of the second airflow Y. More specifically, the opening 50 is made at a point between a rib 40*a* of the case 40 of the developing device 32 and a left roller of the pair of timing rollers 24.

The lower portion of the guide 25*a* is in contact with the outer surface of the case 40 of the developing device 32 and shields the second airflow Y from the developing area D. Thus, the lower portion of the guide 25*a* supports the formation of the second airflow Y.

Figure 3:
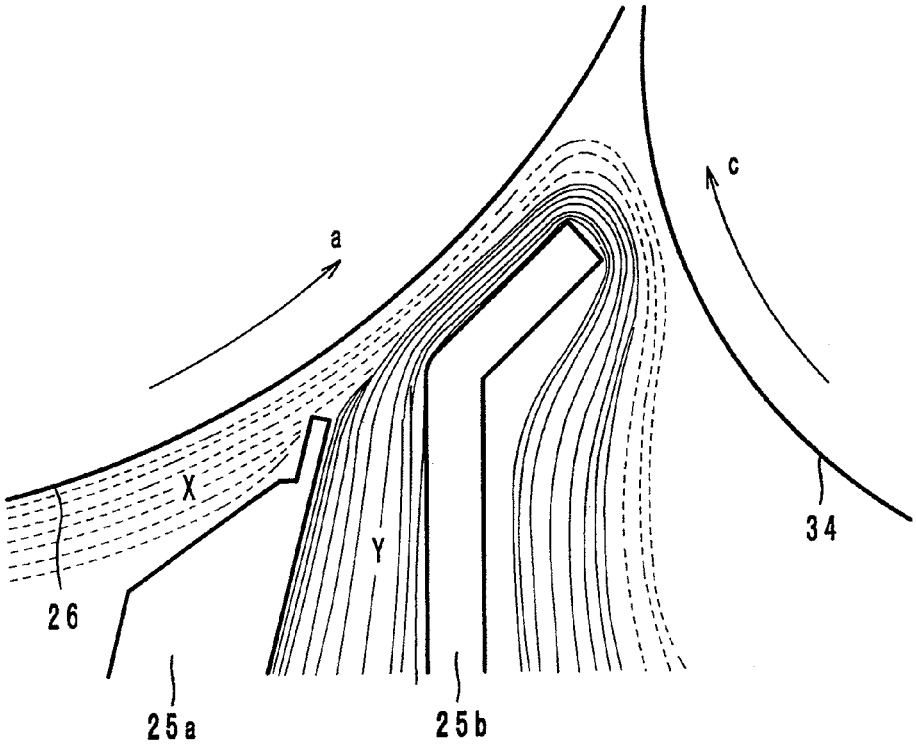
FIG. 3 is an illustration of an airflow between the photosensitive drum and guide members in the image forming apparatus.
Figure 4:
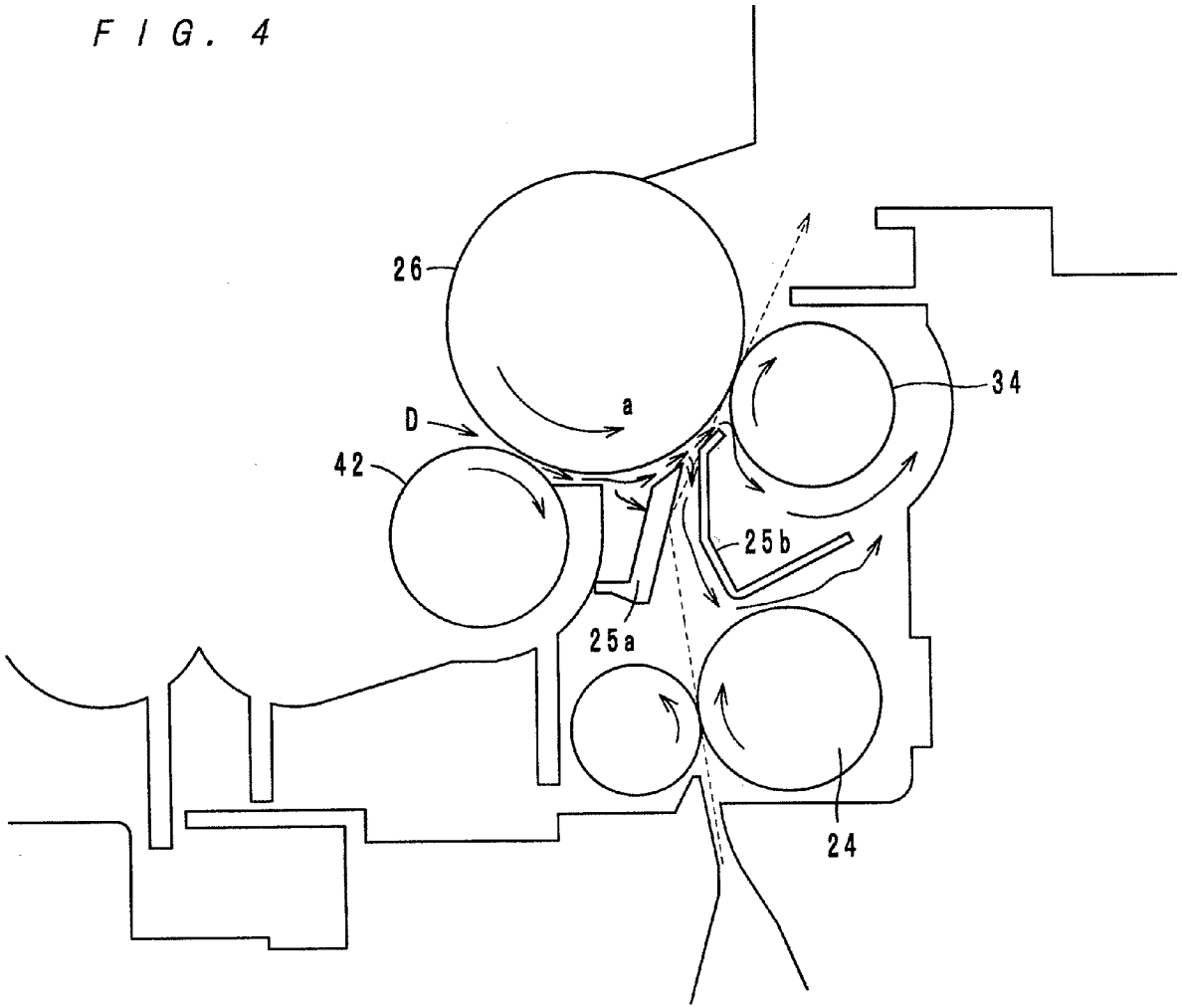
FIG. 4 is an enlarged view of a part of a model of an image forming apparatus that the inventors considered as a premise of the present invention, showing airflows therearound.

The first airflow X and the second airflow Y join together at the upper end of the first guide 25*a*. In this moment, the second airflow Y not carrying toner proceeds appressed to the upper portion of the second guide 25*b* (as shown by thin lines in FIG. 3). The first airflow X comes close to the second airflow Y and proceeds along the second airflow Y without mixing with the second airflow Y (as shown by dotted lines in FIG. 3). Thereafter, the joined airflow Z, as shown by hatched arrows, almost goes around the transfer roller 34 and goes away from the nip portion between the photosensitive drum 26 and the transfer roller 34, and thereafter, the air is exhausted from the apparatus 10.

Thus, the second airflow Y functions as an air curtain for preventing the first airflow X from coming to the locations of the first and the second guides 25*a* and 25*b*. Accordingly, toner flying away from the developing area D and carried by the first airflow X is prevented from flowing to the mutually opposite surfaces of the guides 25*a* and 25*b*, thereby preventing the inside of the apparatus and recording sheets from being begrimed with toner. The first airflow X and the second airflow Y can be formed only by using a conventional fan without making any great modifications to the image forming unit 14.

In order to cause the second airflow Y to bring its function as an air curtain to the full extent, it is preferred that the flow rate of the second airflow Y is larger than that of the first airflow X.

In the image forming apparatus according to the embodiment, the second airflow Y, which does not carry toner, prevents the first airflow X, which carries toner flying from the developing area D, from coming to the locations of the guides 25*a* and 25*b*. In other words, the second airflow Y functions as an air curtain. Thereby, toner flying from the developing area D is prevented from adhering to the guides 25*a* and 25*b*. Thus, the guides 25*a*, 25*b* and other elements in the apparatus and further recording paper can be prevented from being begrimed with toner.

Other Embodiments

The image forming apparatus according to the present invention is not limited to the apparatus 10 shown by FIG. 1 and may be of any type selected from various kinds. The developing device 32 may be of a one-component developer type or may be of a two-component developer type.

Although the present invention has been described in connection with the preferred embodiment above, it is to be noted that various changes and modifications are possible to those who are skilled in the art. Such changes and modifications are to be understood as being within the scope of the present invention.

What is claimed is:

1. An image forming apparatus comprising:

a toner image carrier that rotates in a specified direction;

a developing device comprising a toner supporting member that faces to a surface of the toner image carrier to form a developing area and that rotates in a same direction with the toner image carrier at the developing area;

a transfer member for transferring a toner image from the surface of the toner image carrier onto a recording sheet;

a guide for guiding a recording sheet to between the toner image carrier and the transfer member; and an air aspirator for aspirating air from the developing area and a location of the guide to a location of the transfer member, wherein the air aspirator causes a first airflow which carries toner from the developing area, and a second airflow which does not carry toner from the location of the guide, the second airflow prevents the first airflow from flowing to the location of the guide, and an opening is made at a position upstream from the guide with respect to a direction of the second airflow as an air inlet of the second airflow, wherein the guide comprises a first guide disposed by a side of a recording sheet path near the developing area and a second guide disposed by a side of the recording sheet path near the transfer member, the toner image carrier and the second guide form a path for the first airflow, and the first guide and the second guide form a path for the second airflow.

2. An image forming apparatus according to claim 1, wherein the first guide has an upper end close to the surface of the toner image carrier; and wherein the second guide has an upper portion extending along the surface of the toner image carrier close to the transfer member.

3. An image forming apparatus according to claim 1, wherein the first guide has a lower portion that is in contact with an outer surface of a case of the developing device.

4. An image forming apparatus according to claim 1, wherein the second airflow has a larger flow rate than the first airflow.

* * * * *